United States Patent [19]

Tanaka

[11] 4,068,402

[45] Jan. 17, 1978

[54] TOY VEHICLE AND TRACKWAY

[75] Inventor: Yutaka Tanaka, Urawa, Japan

[73] Assignee: Toytown Corporation, Tokyo, Japan

[21] Appl. No.: 746,195

[22] Filed: Nov. 30, 1976

[51] Int. Cl.[2] ..... A63H 19/10

[52] U.S. Cl. ..... 46/216; 46/257

[58] Field of Search ..... 46/202, 206, 216, 257

[56] References Cited

U.S. PATENT DOCUMENTS

| | | | |
|---|---|---|---|
| 3,589,064 | 6/1971 | Harada | 46/216 |
| 3,613,306 | 10/1971 | Arai | 46/216 |

*Primary Examiner*—Louis G. Mancene
*Assistant Examiner*—Robert F. Cutting
*Attorney, Agent, or Firm*—Staas & Halsey

[57] ABSTRACT

An amusement device consisting of a vehicle provided with wheels, first continuously rotating gears, and a stationary second gear mounted concentrically about one of the first rotating gears; and a trackway engaged by the wheels of the vehicle and provided with a carrier for the vehicle which is mounted to rotate between spaced apart end portions of the trackway and normally biased against one of the end portions such that after the vehicle enters the carrier its momentum causes the carrier and the vehicle to be rotated to the other end portion of the trackway to continue its movement along the trackway, and a tower positioned along the trackway having upstanding side portions provided with continuous racks to be engaged by the rotating gears of the vehicle to propel the vehicle upwardly therealong and an abbreviated rack provided on one of the upstanding side portions to be engaged by the stationary gear to cause the vehicle to perform somersaults as it moves upwardly along the tower.

6 Claims, 7 Drawing Figures

TOY VEHICLE AND TRACKWAY

DESCRIPTION OF THE PREFERRED EMBODIMENT

Figure 1:
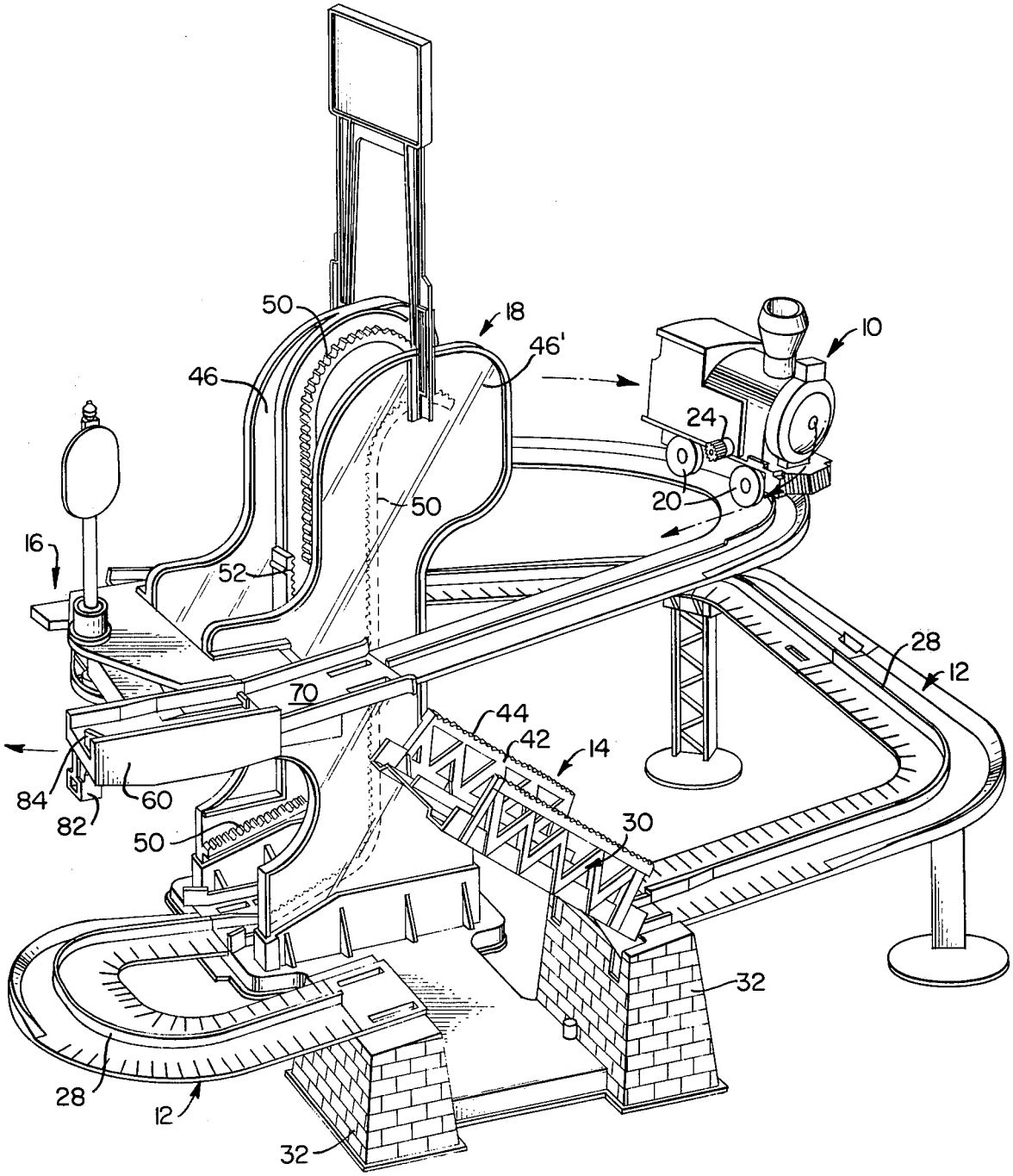
FIG. 1 is a perspective view of the amusement device of the present invention, illustrating the trackway along which the vehicle moves, and the bridge, rotating carrier and somersaulting tower stations.

The amusement device of the present invention as illustrated in FIG. 1 wherein the reference numeral 10 designates a vehicle which moves along a trackway 12 which is provided with a bridge station 14, a rotating carrier station 16, and a somersaulting tower station 18.

Figure 3:
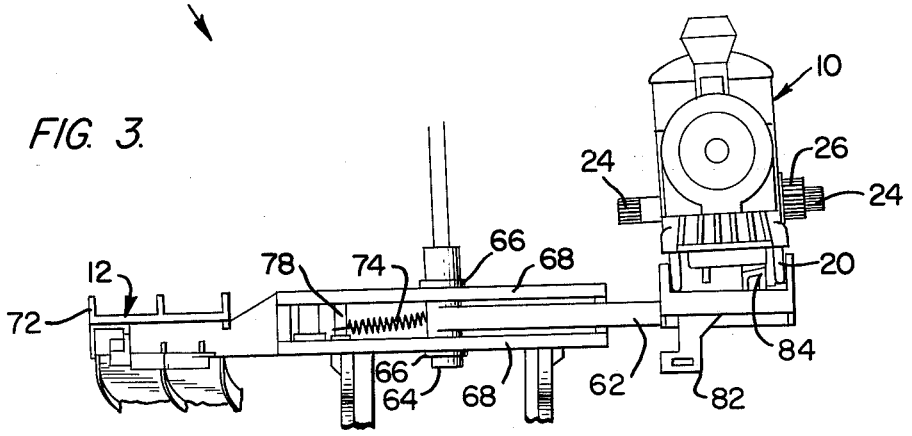
FIG. 3 is a side elevational view of the rotating carrier station of the amusement device, illustrating the vehicle positioned on the carrier, and the spring biasing mechanism which normally positions the carrier adjacent one end of the trackway for receiving the vehicle and which subsequently returns the carrier to this end of the trackway after the vehicle has been transported to the next section of the trackway for movement therealong.
Figure 6:
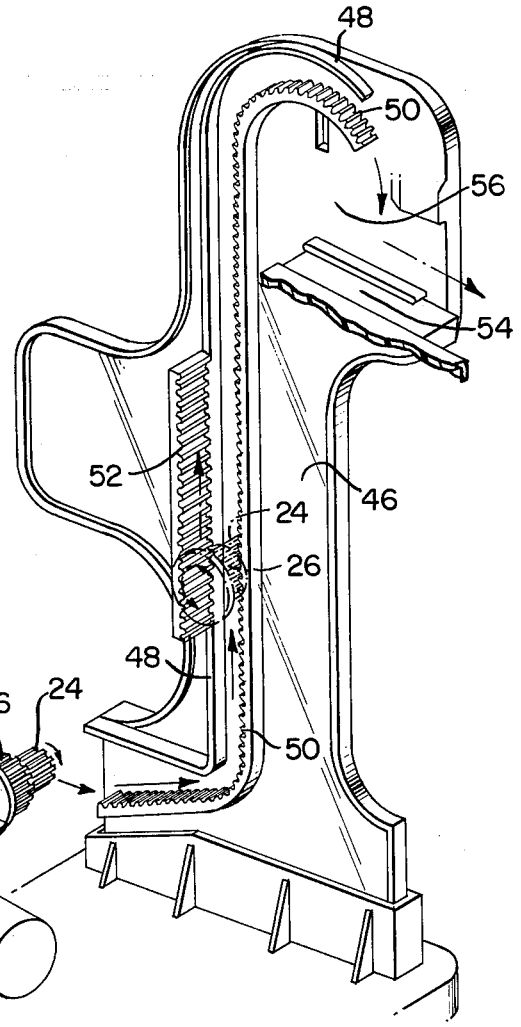
FIG. 6 is a perspective view of one of the upstanding side portions of the somersaulting tower station of the amusement device, illustrating in particular the continuous and abbreviated racks of teeth and the relationship thereto of the rotating and stationary gears extending from the vehicle whereby upward movement of the vehicle along the tower is accomplished by the rotating gears meshing with and advancing along the continuous racks formed in each of the upstanding side portions, and the performance of somersaults by the simultaneous meshing of the stationary gear and the abbreviated rack.

The vehicle 10, as illustrated in FIGS. 1 and 3, is provided with wheels 20 which are suitably mounted to freely rotate such that the vehicle 10 under the influence of gravity rolls freely down the trackway 12. The vehicle 10 is also provided with a miniature motor 13 of conventional configuration well known in the art, which may be electrically powered by batteries or mechanically energized by springs, and which is appropriately mounted to drive a shaft 22 (FIG. 6) which extends transversely of the vehicle 10 and to which two gear wheels 24 are attached. Thus, the gear wheels 24 continuously rotate when the motor is operated. The construction of such miniature electric motors, and the gearing relationship of the motor to the drive shaft to which the gears are mounted, is well known in the art and disclosed for example in U.S. Pat. No. 3,613,306, the subject matter thereof being incorporated herein by specific reference. Fixedly secured to the side of the vehicle 10 is a stationary gear wheel 26, which as illustrated in FIG. 6 is positioned concentrically about the gear wheel 24 associated therewith. The purpose of the continuously rotating gear wheels 24 and the stationary gear wheel 26 will be described hereinafter.

The trackway 12 is provided along its center with an upstanding rail 28 which is positioned between the wheels 20 of the vehicle 10 to serve to guide the vehicle 10 along the trackway 12.

Figure 5:
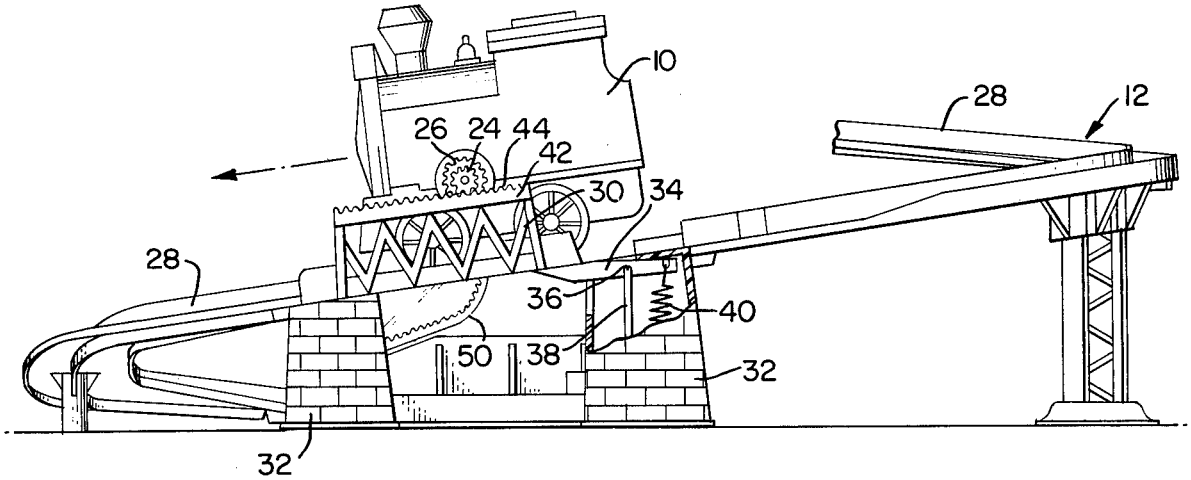
FIG. 5 is a front elevational view of the bridge station of the amusement device, illustrating in particular the spring mechanism which normally biases the bridge in an upward position, and the interrelationship between the continuously rotating gears which extend outwardly of the vehicle and their mating racks of teeth formed along the rails of the bridge which is responsible for propelling the vehicle across the bridge.

The bridge section 14, as illustrated in FIGS. 1 and 5, includes a bridge 30 which spans two abutments 32. The bridge 30 is provided with arms 34 which are provided with openings 36 through which rods 38 extend. The rods 38 are mounted within the internal walls of the abutment 32 such that the bridge 30 is free to rotate about those portions of the rods 36 which extend through the arms 34. It will also be apparent that a spring 40 which is secured at one end to the abutment 32 and at the other end to one of the arms 34 normally holds the bridge 30 in a raised position, as illustrated in FIG. 1. The bridge 30 is provided with rails 42 which are provided with continuous racks of teeth 44, it being apparent from FIG. 5 that the gear wheels 24 of the vehicle 10 mesh with the racks of teeth 44. Thus, and as illustrated in FIGS. 1 and 5, as the vehicle 10 rolls down the trackway 12 the weight thereof forces the bridge 30 to rotate in a counterclockwise direction and eventually the gear wheels 24 engage the continuous racks of teeth 44 such that the rotation of the gear wheels 24 along the racks of teeth 44 propels the vehicle 10 over the bridge 30. After the vehicle 10 leaves the bridge section 14, the spring 40 causes the bridge 30 to be raised once again and the vehicle continues to move down the trackway 12 under the influence of gravity.

The vehicle then enters the somersaulting tower station 18 which is provided with upstanding side portions 46 and 46', each of which is provided with a rail 48 and a continuous rack of teeth 50 spaced therefrom. The configuration of the rails 48 and racks 50 of the upstanding side portions 46 and 46' is identical, it being noted that the position of the rack 50 of the nearest side portion 46' is shown in dotted lines in FIG. 1. The upstanding side portion 46 is also provided with an abbreviated rack of teeth 52 along only a part of the rack 50, the purpose of which will be described hereinafter.

From the foregoing, it will be apparent that the vehicle 10 rolls down the trackway 12 under the influence of gravity into the bottom of the tower station 18, at which time the rotating gear wheels 24 engage the racks of teeth 50. Rotation of the gear wheels 24 along the racks 50 causes the vehicle 10 to move upwardly along the racks 50, it being understood that the rails 48 function to confine the rotating wheels 24 into engagement with the racks 50. Eventually, and as illustrated in FIG. 6, the vehicle 10 reaches a position wherein the stationary gear wheel 26 engages the abbreviated rack of teeth 52. At this time, the vehicle 10 is caused to rotate or somersault as a result of the rotating gears 24 continuing to move upwardly along the racks 50 while simultaneously the stationary gear 26 moves upwardly along the rack 52. That is, movement of the vehicle 10 through the somersaulting tower station 18 is accomplished by the rotating gears 24 meshing with and advancing along the continuous racks 50 while somersaults are performed by the simultanesous meshing and advancing of the stationary gear 26 along the abbreviated rack 52. After the vehicle 10 leaves the abbreviated rack 52 the somersaulting action terminates but the vehicle 10 continues to move upwardly until the rotating gear wheels 24 leave their mating racks 50, at which time the vehicle 10 is free to roll down the trackway 12. It can be seen from FIG. 6 that one end 54 of the trackway 12 extends into the upper portions 56 of the upstanding side portions 46 and 46' such that as the rotating gears 24 become disengaged from the racks 50 the wheels 20 of the vehicle 10 are positioned along the end 54 of the trackway 12 permitting the wheels 20 to engage the end 54 such that the vehicle 10 can begin to roll down the trackway 12.

Figure 2:
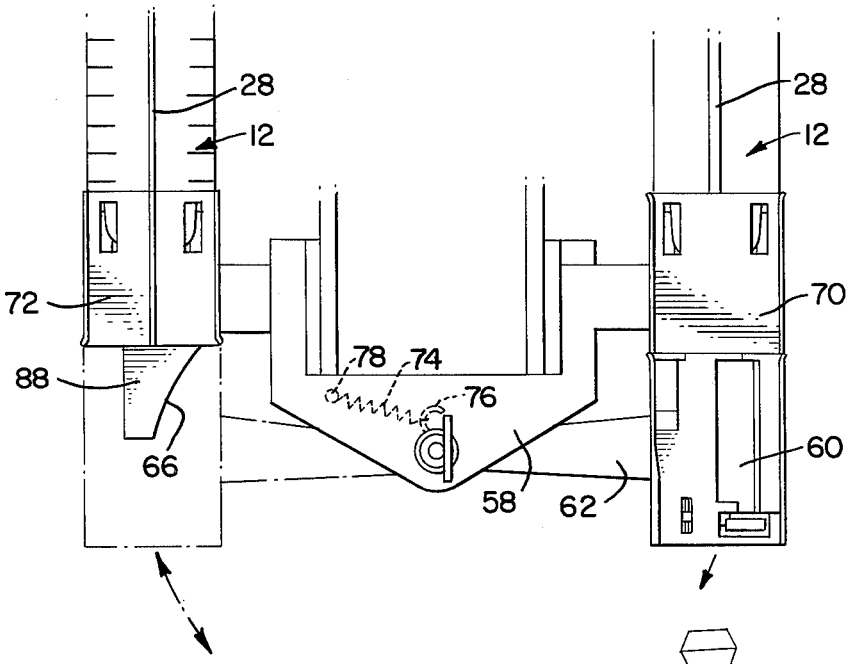
FIG. 2 is a top plan view of the rotating carrier station of the amusement device, illustrating in particular the carrier which is pivotally mounted to rotate under the influence of the momentum of the vehicle from one position along the trackway to another.

From FIG. 1, it will be apparent that the vehicle 10 after leaving the somersaulting tower station 18 rolls down the trackway 12 and eventually enters the rotating carrier station 16. From FIGS. 2–4, it will be apparent that the rotating carrier station 16 includes a frame 58 to which the carrier 60 is rotatably mounted. More particularly, the carrier 60 includes an arm 62 which terminates in a shaft 64 which is positioned within openings 66 provided within the spaced apart members 68 of the frame 58, such that the arm 62 and the carrier 60 attached thereto are free to rotate about an axis corresponding with the shaft 64 between the ends 70 and 72 of the trackway 12. A spring 74 is secured at one end to a post 7 which is attached to the shaft 64 and at the other end thereof to a post 78 formed as a part of the frame 58, such that the spring 74 normally urges the carrier 60 to rotate in a counterclockwise direction into engagement with the end 70 of the trackway 12.

Figure 4:
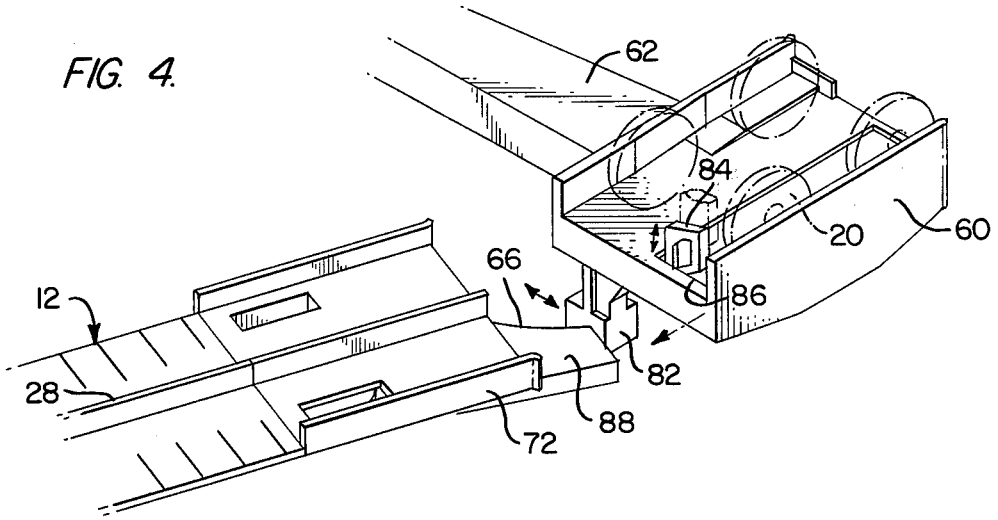
FIG. 4 is a perspective view of a portion of the carrier and one end of the trackway, illustrating in particular the interaction between a flange formed as a part of the end of the trackway and a blocking member which holds the vehicle on the carrier during its rotating movement from one part of the trackway to another.
Figure 7:
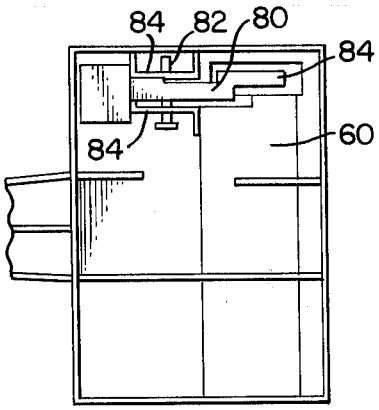
FIG. 7 is a bottom plan view of a portion of the rotatably mounted carrier, illustrating in particular the rotatably mounted arm which is provided with a first abutment which is normally raised through the carrier to engage the front left wheel of the vehicle preventing same from leaving the carrier during movement thereof and a second abutment which eventually strikes a flange extending from the trackway to cause the first abutment to be lowered permitting the vehicle to leave the carrier to continue its movement along the trackway.

It will be apparent from FIGS. 4 and 7 that the carrier 60 is provided with an arm 80 which is mounted to rotate about a shaft 82 which is fixed to the walls 84 of the carrier 60. The arm 80 is provided with a relatively heavy abutment 82 at one end thereof and a relatively light abutment 84 at the other end thereof, such that the abutment 84 is normally raised through an opening 86 provided in the carrier 60.

From the foregoing, it will be apparent that the vehicle 10 rolls down the trackway 12 onto the carrier 60 until the front left wheel 20 engages the abutment 84, afterwhich the momentum of the vehicle 10 causes the carrier 60 to rotate from the end 70 of the trackway 12 to the end 72 thereof. The end 72 of the trackway 12 is provided with a flange 88, as illustrated in FIG. 4, which is positioned in the path of travel of the lower abutment 82 of the carrier 60. Thus, as the carrier 60 nears the end of its rotation, the abutment 82 strikes the curvilinear surface 90 of the flange 88 causing the arm 80 to rotate about the shaft 82 raising the abutment 82 and lowering the abutment 84. From FIG. 4 it will be apparent that the lowering of the abutment 84 from engagement with the front left wheel 20 of the vehicle 10 thus frees the vehicle 10 to move onto the end 72 of the trackway 12, after which the vehicle 10 moves along the trackway 12 and eventually enters the bridge section 14, the operation of which has previously been described.

I claim:

1. An amusement device, comprising:

a vehicle provided with wheels freely mounted for rotation, first driven gears mounted for rotation and a second stationary gear mounted concentrically with respect to one of said first gears; and a trackway against which said wheels of said vehicle rest and provided with guide means for directing said vehicle therealong, and including:

a first section terminating at a first end, a second section beginning at a second end, a carrier for said vehicle, means mounting said carrier to rotate between said first and second ends of said first and second sections, and spring means normally urging said carrier into abutting relationship against said first end such that as said vehicle leaves said first end entering said carrier said vehicle and said carrier are rotated to said second end of said second section at which time said vehicle leaves said carrier entering said second end of said second section, and a third section terminating in a third end, an upstanding tower positioned at said third end, said tower having upstanding side portions provided with first continuous racks positioned to be engaged by said rotating first gears of said vehicle to propel said vehicle upwardly along said side portions of said tower, one of said side portions also being provided with a second rack spaced apart from said first rack and positioned to be engaged by said second stationary gear of said vehicle to cause said vehicle to rotate about said second gear simultaneously while moving upwardly along said side portions of said tower, and a fourth section terminating in a fourth end located in the vicinity of the uppermost portions of said first racks such that as said vehicle leaves said tower it enters said fourth section.

2. An amusement device as in claim 1, wherein said first, second, third and fourth sections of said trackway slope downwardly.

3. An amusement device as in claim 1, further comprising fifth and sixth sections of said trackway spaced apart from each other, a bridge spanning said fifth and sixth sections, one end of said bridge being pivotally mounted for rotation, spring means normally urging said bridge to a first position wherein the other end of said bridge is positioned above said fifth section, and racks provided on said bridge and positioned to be engaged by said rotating first gears of said vehicle to propel said vehicle along said bridge at which time said other end of said bridge is lowered into engagement with said fifth section of said trackway.

4. An amusement device as in claim 3, wherein said fifth and sixth sections of said trackway slope downwardly.

5. An amusement device as in claim 4, wherein said first and fourth sections intersect each other, said second and sixth sections intersect each other, and said third and fifth sections intersect each other.

6. An amusement device as in claim 1, further comprising an arm mounted to said carrier for rotation, said arm having a first abutment normally positioned to be engaged by one of said wheels of said vehicle to prevent said vehicle from leaving said carrier as said carrier rotates and a second abutment, a flange extending from said second end of said second section and positioned to engage said second abutment as said carrier approaches said second end so as to rotate said arm moving said first abutment so as to permit said vehicle to leave said carrier.

* * * * *